US006029941A

United States Patent [19]

Mayzes

[11] Patent Number: 6,029,941

[45] Date of Patent: Feb. 29, 2000

[54] TRUNK LID SUPPORT

[76] Inventor: Samuel J. Mayzes, 166 Sems Rd., Gaston, S.C. 29053

[21] Appl. No.: 09/039,038

[22] Filed: Mar. 13, 1998

Related U.S. Application Data

[60] Provisional application No. 60/041,186, Mar. 21, 1997.

[51] Int. Cl.[7] ..... A47F 5/00

[52] U.S. Cl. ..... 248/352; 248/354.3

[58] Field of Search ..... 248/352, 354.1, 248/354.2, 354.3, 354.4, 354.5, 276.1, 279.1, 295.11; 292/339, 288, 262

[56] References Cited

U.S. PATENT DOCUMENTS

| | | | |
|---|---|---|---|
| 2,671,355 | 3/1954 | Hawkins | 74/532 |
| 2,685,353 | 8/1954 | Caskie | 403/108 |
| 4,070,050 | 1/1978 | Glock et al. | 292/339 |
| 4,650,427 | 3/1987 | Huchinson | 440/55 |
| 4,667,993 | 5/1987 | Hannesson et al. | 292/339 |
| 5,238,213 | 8/1993 | Pool | 248/352 |
| 5,551,738 | 9/1996 | Thorlton | 292/262 |
| 5,647,619 | 7/1997 | DeLisio | 292/288 |

*Primary Examiner*—Derek J. Berger
*Assistant Examiner*—David Heisey
*Attorney, Agent, or Firm*—Michael A Mann; Nexsen Pruet Jacobs & Pollard LLP

[57] ABSTRACT

A device to secure a trunk lid in an open position is disclosed. The device comprises a telescoping shaft with two ends. These two ends secure the two portions of the latch system of an automobile. Most automobiles have a pair of jaws on one part of this latching system and a transverse rod on the other part of the latching system. When the trunk lid is closed normally, the jaws grip the rod to lock the trunk lid closed. In the present invention, one end of the device has a loop to secure within the jaws and the other end of the device has a notch and locking pin to straddle and secure itself to the rod. A metal extension on the notched end in electrical connection with the loop at the other end of the present device can be used to trick an electrically operated trunk lid into thinking the lid is fully closed when the present device is actually in place.

12 Claims, 2 Drawing Sheets

TRUNK LID SUPPORT

This application claims the benefit of provisional patent application Ser. No. 60/041,186, filed Mar. 21, 1997.

BACKGROUND OF THE INVENTION

1. Field of the Invention

The present invention relates to supports for automobile trunk lids and in particular for supports that temporarily hold a trunk lid open in order to transport larger items.

2. Discussion of Background

Automobile trunks are designed for holding a reasonable quantity of luggage plus a spare tire and perhaps a few tools. The overall amount of space is constrained however by the design of the rear deck of the car with respect to the ground. Some cars, such as sports cars, have notoriously small trunks.

When a larger object, such as a Christmas tree, must be transported by the vehicle, its operator has little option but to leave the trunk lid open. If the operator has a length of rope, the lid can be tied down onto the object. If not, the lid will tend to bounce as the car is driven. Neither of these approaches is satisfactory.

Furthermore, if there were a solution to this problem, namely, if there were a device for holding the trunk lid open in such a way that it did not bounce, the device would have to be inexpensive, easy to use, and adapted to work on a variety of automobiles.

SUMMARY OF THE INVENTION

According to its major aspects and briefly recited, the present invention is a device for holding a trunk lid in an open position so that a large object can be accommodated in the trunk for transport by the car. The device comprises a telescoping shaft with two ends, a first end designed to engage one part of the trunk latch system and the opposing second end designed to engage the other part of the trunk latch system. Once adjusted to the desired position, the telescoping shaft can be locked there to hold the trunk lid at the desired position. For cars with electrically operated lids, the device is designed to make electrical contact between a cut-off switch in the trunk sill and the lid so the car's trunk lid control system will "think" that the lid is fully closed.

Two important, related features of the present invention are the designs of the shaft's ends that engage the respective parts of the trunk latch system. These latch parts already exist on vehicles and are designed for securing the lid to the body of the vehicle. Therefore, using them in cooperation with the present device reduces the complexity of the present device and locks it into place with the same level of security as if the trunk lid were fully closed.

Moreover, when in place these ends have sufficient movement to allow a readjustment of the lid to be a little more or a little less open without releasing them from their attachments.

Another important feature of the present invention is the metallic contact that engages the cut-off switch of cars with electrically powered trunk lids. Although this contact is only necessary where the device is made entirely of metal, without this switch to "trick" the control mechanism into "thinking" the lid is fully closed, the lid would oscillate between a position engaging the top of the object in the trunk and a fully opened position.

Other features and their advantages will be apparent to those skilled in the art of trunk lid supports from a careful reading of the Detailed Description of Preferred Embodiments accompanied by the following drawings.

DETAILED DESCRIPTION OF PREFERRED EMBODIMENTS

The present invention is a device for use in securing a trunk lid in an open position. Most trunk lids have similar hardware for a latch system. One part of the latch system is on the lid and the other part in built into the trunk sill, which is the part of the body of the car that runs toward each side of the car from the rear of the car. One part of this latch system includes a rod usually secured within a recess; the other part of the latch system includes two spring loaded jaws. When a trunk lid is closed, the jaws of one part are separated by the rod coming between them and then closed over the rod as it passes between them. The jaws may be locked in this position with the trunk key. Either trunk latch part may be on the lid and the other on the sill. For simplicity in this description, however, it will be assumed that the jaws are on the lid and the rod-and-recess part is located in the sill. However, it will be clear that if the jaws were in the recess on the sill and the rod was on the lid, the present device would operate in the same fashion as described except for being upside down.

Figure 1:
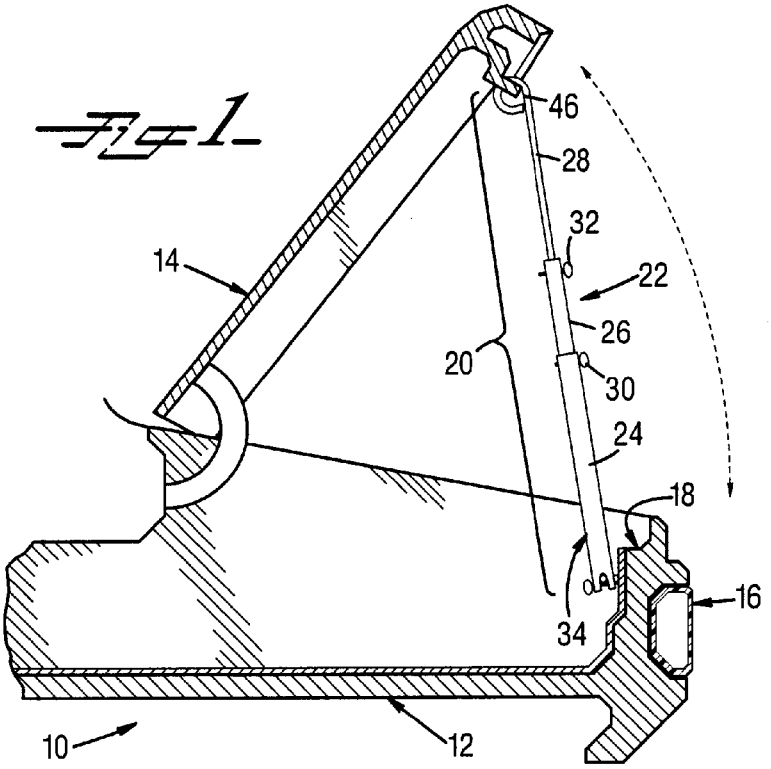
FIG. 1 is a side cross-sectional view of a portion of an automobile showing the trunk area with the trunk lid open and a device in place to secure the lid in that open position, according to a preferred embodiment of the present invention.

FIG. 1 shows the rear portion of an automobile generally indicated with reference number 10. Automobile 10 has a body 12 and a trunk lid 14, here shown in an open position. The rear of the automobile is indicated by reference number 16 and trunk sill by reference number 18.

A device 20 according to a preferred embodiment of the present invention is shown holding lid 14 in the open position. Device 20 comprises a shaft 22 having, in this embodiment, three sections: first section 24, second section 26 and third section 28. First and second sections 24 and 26 are hollow metal tubes with the outer diameter of second section 26 being just slightly smaller than the inner diameter of first section 24, so that second section 26 slides easily within first section 24. Third section 28 is preferably a solid rod having an outer diameter just slightly smaller than the inner diameter of second section 26 so that third section 28 slides freely inside second section 26. To lock second section 26 inside first section 24, a threaded key 30 in a threaded hole in first section 24 engages the outside surface of second section 26 to hold it where desired. Third section 28 is secured to section 26 in a similar fashion. There are, of course, numerous ways of locking telescoping sections together. These include ball detent mechanisms, cam locks, collar nuts, and many others. Therefore, the present invention is not limited to the embodiment shown, but includes any mechanism for temporarily fixing the position of a slidable rod or tube within another tube.

Figure 2A:
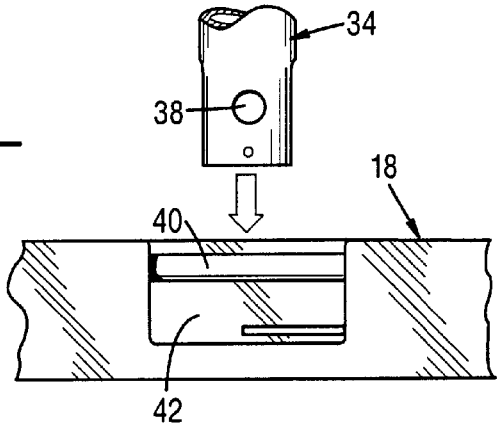
FIGS. 2A and 2B show the front and side views, respectively, of the first end of a device as it engages the part of the trunk latch on the sill of the trunk, according to a preferred embodiment of the present invention.
Figure 2B:
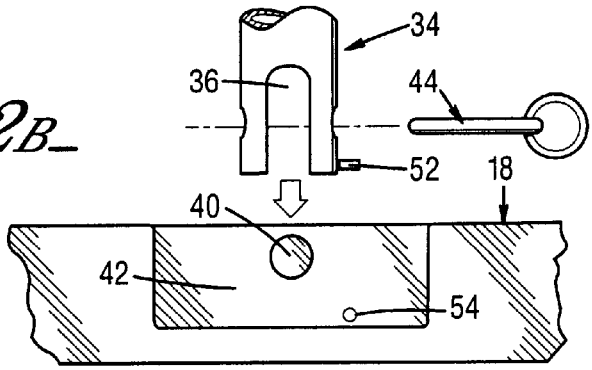

FIGS. 2A and 2B illustrate a detail of device 20, namely, the first end 34. First end 34 has a notch 36 and a pair of holes 38 formed in first section 24. Notch 36 engages the part of the latch system located in sill 18 of automobile 10 by straddling a rod 40 in a recess 42 in sill 18. When fully seated in recess 42, a locking pin 44 is inserted through holes 38 to keep rod 40 within notch 36 and thus first end 34 in place in sill 18.

Figure 3A:
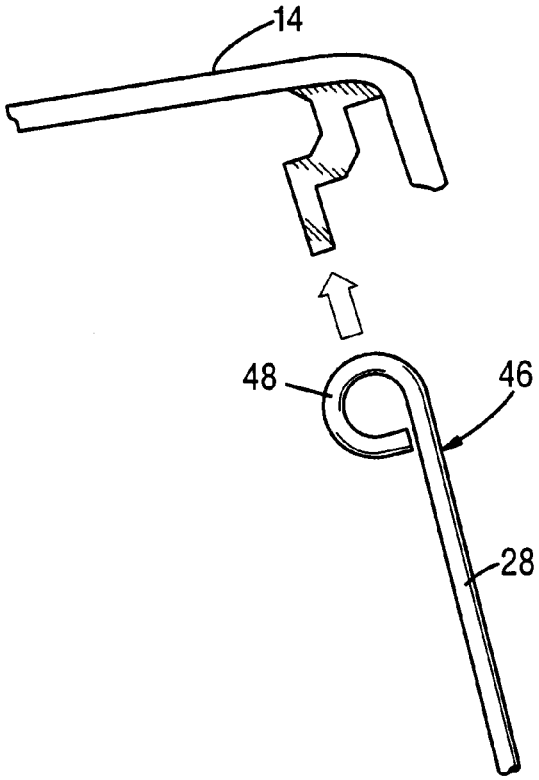
FIGS. 3A and 3B show the front and side views, respectively, of the second end of the present device as it engages the part of the trunk latch on the trunk lid.
Figure 3B:
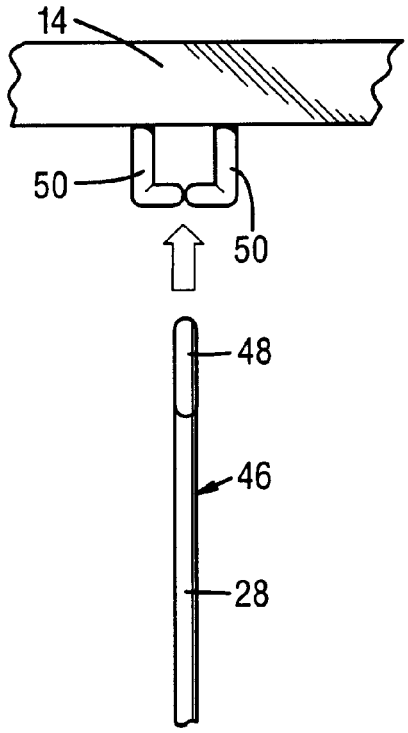

In FIGS. 3A and 3B is illustrated another detail of device 20, namely, the second end 46. Second end 46 is a loop 48 formed from the end of third section 28. Loop 48 is preferably angled forward slightly as shown. Loop 48 is moved into position by sliding it between spring loaded jaws 50 on lid 14 to separate them and receive loop 48 therebetween. Jaws 50 close over loop 48 and can be locked in place to secure loop 48.

To use device 20, first end 34 is rotated to align notch 36 with the axis of rod 40 and then lowered onto rod 40 until pin 44 can be inserted into holes 38 to lock first end 34 in place. Keys 30 and 32 are loosened to allow sections 26 and 28 to slide within sections 24 and 26, respectively. Second end 46 and trunk lid 14 are brought together where lid 14 will be at the desired position to accommodate whatever object has been placed in the trunk of automobile 10. At that position, loop 48 of second end 46 is moved between jaws 50, and keys 30, 32 are tightened. Lid 14 will remain at that position until jaws 50 release loop 48 or pin 44 is removed from holes 38 so that first end 34 can be lifted from rod 40.

Device 20 is preferably made of metal, but for most automobiles, any reasonably rigid material will do, including some plastics such as nylon and composites such as graphite or fiberglass impregnated polymers.

For embodiments made from metal or having an electrically conductive core and where the automobile has an electrically-operated trunk lid, first end 34 needs to have a deeper notch 36 to allow for a small metal extension 52 that will engage a cut-off contact switch 54 in recess 42. It is clear that these changes are not necessary when device 20 is made from a material not capable of carrying electrical current, such as plastic, nylon or fiberglass.

It will be readily apparent to those skilled in the art of trunk lid supports from reading the foregoing that many substitutions and modifications may be made to the preferred embodiments described without departing from the spirit and scope of the present invention.

What is claimed is:

1. A device for holding the trunk lid of a vehicle in an open position, said vehicle having a trunk latch system with a rod and jaws, said device comprising:

a shaft having a first end and an opposing second end;

a member carried by said first end of said shaft and having a notch formed therein, said member adapted to rest on said rod of the latch system when the rod is received within said notch, said member having a pair of through holes formed in said member, one through hole formed on each side of said notch, said through holes being aligned across said notch;

a pin dimensioned to fit through said through holes of said member; and a loop carried by said second end of said shaft and having a hole through said loop, said loop capable of engaging the jaws of the latch system.

2. The device as recited in claim 1, further comprising means for adjusting the length of said shaft.

3. The device as recited in claim 1, wherein said shaft comprises:

a hollow first section having an inner dimension;

a second section having a smaller outer dimension than said inner dimension of said first section, said second section being slidably receivable within said first section; and locking means for fixing said second section with respect to said first section.

4. A device for holding the trunk lid of a vehicle in an open position, said vehicle having a trunk latch system with a rod, jaws, and electronic switch, said device comprising:

a shaft having a first end and opposing second end;

a member carried by said first end of said shaft and having a notch, said member adapted to rest on said rod of the latch system when said rod is received within said notch, said member having a pair of through holes formed in said member, one through hole formed on each side of said notch, said through holes being aligned across said notch;

a pin dimensioned to fit through said through holes of said member;

a loop carried by said second end of said shaft and having a hole through said loop, said loop engaging the jaws of the latch system; and trigger means carried by said first end of said shaft for closing said electronic switch of said latch system.

5. The device as recited in claim 4, further comprising means for adjusting the length of said shaft.

6. The device as recited in claim 4, wherein said shaft comprises:

a hollow first section having an inner dimension;

a second section having a smaller outer dimension than said inner dimension of said first section, said second section being slidably receivable within said first section; and locking means for fixing said second section with respect to said first section.

7. The device as recited in claim 4, wherein said shaft is electrically conductive and said trigger means comprises an electrically conductive member carried by said first end of said shaft so that, when said member is in electrical connection with said switch, said switch closes and electricity can be conducted between said jaws and said rod of said trunk latch system.

8. A device for holding the trunk lid of a vehicle in an open position, said vehicle having a trunk latch system with a rod, jaws, and electronic switch, said device comprising:

a shaft having a first end and an opposing second end;

a member carried by said first end of said shaft and having a notch, said member adapted to rest on said rod of said latch system when said rod is received within said notch, one through hole formed on each side of said notch, said through holes being aligned across said notch;

a pin dimensioned to fit through said through holes of said member;

second end securing means carried by said second end of said shaft, for securing said second end of said shaft to said jaws of said latch system;

adjusting means carried by said shaft for adjusting the length of said shaft; and trigger means, carried by said first end of said shaft, for closing said switch of said latch system.

9. The device as recited in claim 8, wherein said second end securing means is a loop carried by said second end of said shaft and having a hole through said loop, said loop engaging said jaws of said latch system.

10. The device as recited in claim 8, wherein said shaft comprises:

a hollow first section having an inner dimension;

a second section having a smaller outer dimension than said inner dimension of said first section, said second section being slidably receivable within said first section; and locking means for fixing said second section with respect to said first section.

11. The device as recited in claim 8, wherein said shaft is electrically conductive and said trigger means comprises an electrically conductive member carried by said first end of said shaft so that, when said member is in electrical connection with said switch, said switch closes and electricity can be conducted between said jaws and said rod of said trunk latch system.

12. The device as recited in claim 8, wherein said shaft comprises:

a hollow first section having a inner dimension;

a hollow second section having an inner dimension and an outer dimension, said second section having a smaller outer dimension than said inner dimension of said first section, said second section being slidably receivable within said first section;

a hollow third section having an outer dimension, said third section having a smaller outer dimension than said inner dimension of said second section, said third section being slidably receivable within said second section;

first locking means for fixing said second section with respect to said first section; and second locking means for fixing said third section with respect to said second section.

* * * * *